US006896114B1

(12) United States Patent
Matsumoto et al.

(10) Patent No.: US 6,896,114 B1
(45) Date of Patent: May 24, 2005

(54) COIN DISPENSING APPARATUS FOR AUTOMATIC VENDING MACHINE

(75) Inventors: Takashi Matsumoto, Saitama (JP); Toshikatsu Kamoda, Saitama (JP)

(73) Assignee: Fuji Electric Co., Ltd., Kanagawa (JP)

( * ) Notice: Subject to any disclaimer, the term of this patent is extended or adjusted under 35 U.S.C. 154(b) by 408 days.

(21) Appl. No.: 09/653,988

(22) Filed: Sep. 1, 2000

(30) Foreign Application Priority Data

Sep. 3, 1999 (JP) ..... 11-250930
Sep. 3, 1999 (JP) ..... 11-250931

(51) Int. Cl.[7] ..... G07G 3/00

(52) U.S. Cl. ..... 194/202; 194/215; 194/344; 194/346; 453/21; 453/26; 453/41; 453/45

(58) Field of Search ..... 194/202, 215, 194/253, 335, 344–346; 209/596; 221/274; 453/1, 3, 4, 17, 18, 21, 26–28, 41, 45–47

(56) References Cited

U.S. PATENT DOCUMENTS 3,916,922 A * 11/1975 Prumm ..... 194/346
4,157,139 A * 6/1979 Bjork ..... 198/397.05
4,234,072 A * 11/1980 Prumm ..... 194/317
4,347,924 A * 9/1982 Hayashi et al. ..... 194/346
5,052,538 A * 10/1991 Satoh ..... 194/317
5,554,070 A * 9/1996 Takatoshi et al. ..... 134/131
5,688,165 A * 11/1997 Levasseur ..... 453/9
5,697,483 A * 12/1997 Ishida et al. ..... 194/217
5,760,342 A * 6/1998 Takeda et al. ..... 177/25.18
5,810,654 A * 9/1998 Suzuki et al. ..... 198/587
5,964,657 A * 10/1999 Abe et al. ..... 453/3
6,086,472 A * 7/2000 Furukawa ..... 194/346
6,318,537 B1 * 11/2001 Jones et al. ..... 194/346
6,346,039 B2 * 2/2002 Orton et al. ..... 453/3
6,386,964 B1 * 5/2002 Thomas ..... 453/17

FOREIGN PATENT DOCUMENTS

JP 8-147514 6/1996

* cited by examiner

*Primary Examiner*—Donald P. Walsh
*Assistant Examiner*—Jeffrey Shapiro
(74) *Attorney, Agent, or Firm*—McDermott Will & Emery LLP

(57) ABSTRACT

A coin dispensing apparatus which is simple in structure and can prevents rise in cost and money exchange fraud. The apparatus comprises an inserting aperture 2 which is provided at the upper part of the body 1 and into which coins 3 are put, a sorting unit 4 which comprises a coin discriminating device 40 discriminating genuineness of coins 3 put into it through the inserting aperture 2, and sorts the coins so discriminated, a coin storing unit 6 which is located under the sorting unit 4 and stores coins 3 sorted every coin kind, a holding unit 5 which is provided between the coin storing unit 6 and the sorting unit 4, and holds temporally coins 3 sorted by the sorting unit 4 every coin kind, and a coin repayment unit 7 which is provided at the lower part of the body 1 and returns coins 3.

6 Claims, 12 Drawing Sheets

COIN DISPENSING APPARATUS FOR AUTOMATIC VENDING MACHINE

FIELD OF THE INVENTION

This invention relates to a coin dispensing apparatus, and more particularly to a coin mechanism to be installed in an automatic vending machine, etc.

BACKGROUND OF THE INVENTION

Formerly, in an automatic vending machine, there was an anxiety that genuine coins within the body of a coin dispensing apparatus is taken out intentionally by first throwing counterfeited coins into the machine and then making returning operation thereof, namely, for so-called money exchange fraud. In addition, in an automatic vending machine in recent years, many coins are put into it at one time of deal. Accordingly, it is desirable that a coin dispensing apparatus is provided with a temporary holding unit to hold coins to be put into it.

In this case, it is typical to adopt a structure in which the temporary holding unit is provided with a holding cylinder to hold coins therein and a coin positioned at the lowest position is swept by a wiper.

However, there is a case where an article is purchased after a coin was put into the machine, namely, the coin put into the machine is received, while there is another case where an article is not purchased and the coin put into the machine is returned by reason that a desired article has been sold out, a customer changes his mind, or money exchange fraud is conducted. Accordingly, a sorting mechanism, which sorts coins to coin receiving cylinders to be provided every kind of coin or an returning window, becomes necessary to be provided under the holding unit.

Accordingly, there occurs a problem that a sorting mechanism must be further provided under the temporary holding cylinder, which requires to make the coin dispensing apparatus larger in the up-and-down direction.

In order to solve this problem, Japanese patent application Laid-open No.8-147514 discloses a conventional coin dispensing apparatus comprising a coin sorting unit which discriminated genuineness of coins put into it, an allotting unit which allots genuine coins and counterfeited coins discriminated by the coin sorting unit to a receiving passage and a returning passage, respectively, and a plurality of change storing cylinders in which the coins allotted to the receiving passage are stored every coin kind, wherein the apparatus is provided with a holding cylinder which is positioned between the receiving passage and the change storing cylinders and holds the coins allotted to the receiving passage, and a coin-sweeping unit which sweeps the coins discharged from the holding cylinder, when an article is sold, to the change storing cylinders and, when returned, to the returning passage.

And, the holding tube of the coin dispensing apparatus comprises an entrance for coin which is formed midway in its up-and-down direction, a lifting mechanism which lifts coins held at the lower part of the holding cylinder, and a discharging mechanism which discharges the coin lifted by the lifting mechanism.

In the conventional coin dispensing apparatus, however, there are disadvantages in that its structure becomes complicated, the fabrication or working efficiency and the production cost is high, since the lifting mechanism must be provided.

SUMMARY OF THE INVENTION

Accordingly, it is an object of the invention to provide a coin dispensing apparatus which is simple in structure.

It is a further object of the invention to provide a coin dispensing apparatus which is low in the production cost.

According to the first aspect of the invention, a coin dispensing apparatus, comprises:

an inserting aperture, provided at an upper part of a main body, for receiving coins to be inserted thereinto;

a sorting unit comprising a coin discriminating device for discriminating genuineness of coins inserted into the inserting aperture, the sorting unit sorting the coins discriminated in the coin discriminating device;

a coin storing unit, located under the sorting unit, for storing the coins sorted in the sorting unit by separating the coins in kinds of the coins;

a holding unit, provided between the coin storing unit and the sorting unit, for temporally holding the coins sorted in the sorting unit; and a coin repayment unit, provided at a lower part of the main body, for returning the coins to a customer.

In accordance with a coin dispensing apparatus as defined above, the holding unit can be structured simple without using a lifting mechanism.

According to the second aspect of the invention, a coin dispensing apparatus, comprises:

an inserting aperture, provided at an upper part of a main body, for receiving coins to be inserted thereinto;

a sorting unit comprising a coin discriminating device for discriminating genuineness of coins inserted into the inserting aperture, the sorting unit sorting the coins discriminated in the coin discriminating device;

a holding unit for temporally holding the coins sorted in the sorting unit;

a coin storing unit provided under the holding unit; and a coin repayment unit, provided at it lower part of the main body, for returning the coins to a customer;

wherein the coin dispensing apparatus has a holding cylinder provided in the holding unit for temporally holding the coins, a wiper provided at a lower part of the holding cylinder for sweeping the coins, and a sorting device provided under the wiper for sorting the coins to the coin storing unit or the coin repayment unit.

In the preferred embodiment, the coin dispensing apparatus may have a coin storing passage connected with the coin storing unit and a repayment passage connected with the coin repayment unit, and a damper provided in the sorting device for switching the coin storing passage and the repayment passage.

In the preferred embodiment, the coins may be more than one kind.

In accordance with a coin dispensing apparatus as defined above, since the apparatus has a structure that the coin storing passage and the repayment passage, which are provided under the wiper and being indispensable structure, are switched by the damper, it becomes unnecessary to provide a lifting unit additionally, so that coins can be sorted to the coin storing unit or the coin repayment unit without the need to make the coin dispensing apparatus larger.

According to the third aspect of the invention, a coin dispensing apparatus, comprises:

an inserting aperture, provided at an upper part of a main body, for receiving coins to be inserted thereinto;

a sorting unit comprising a coin discriminating device for discriminating genuineness of coins inserted into the inserting aperture, the sorting unit sorting the coins discriminated in the coin discriminating device;

a holding unit for temporally holding the coins sorted in the sorting unit;

a coin storing unit provided under the holding unit; and a coin repayment unit, provided at a lower part of the main body, for returning the coins;

wherein the coin dispensing apparatus has a holding cylinder provided in the holding unit for temporally holding the coins, a wiper provided at a lower part of the holding cylinder for sweeping the coins, and a receiving member provided near the wiper for sorting the coins to the coin storing unit or the coin repayment unit by operation with or without being linked to the wiper.

In the preferred embodiment, operation of the receipt member may be linked with the wiper in storing coins in the coin storing unit, and may not be linked with the wiper in sweeping coins to the coin repayment unit.

In the preferred embodiment, the coins may be more than one kind.

In accordance with a coin dispensing apparatus as defined above, since the receiving member which operates in linkage with the wiper or individually, coins can be sorted to the coin storing unit or the coin repayment unit without making the coin dispensing apparatus larger.

BRIEF DESCRIPTION OF THE DRAWINGS

The invention will be described in more detail in conjunction with the appended drawings, wherein.

DETAILED DESCRIPTION OF THE PREFERRED EMBODIMENT

Figure 1:
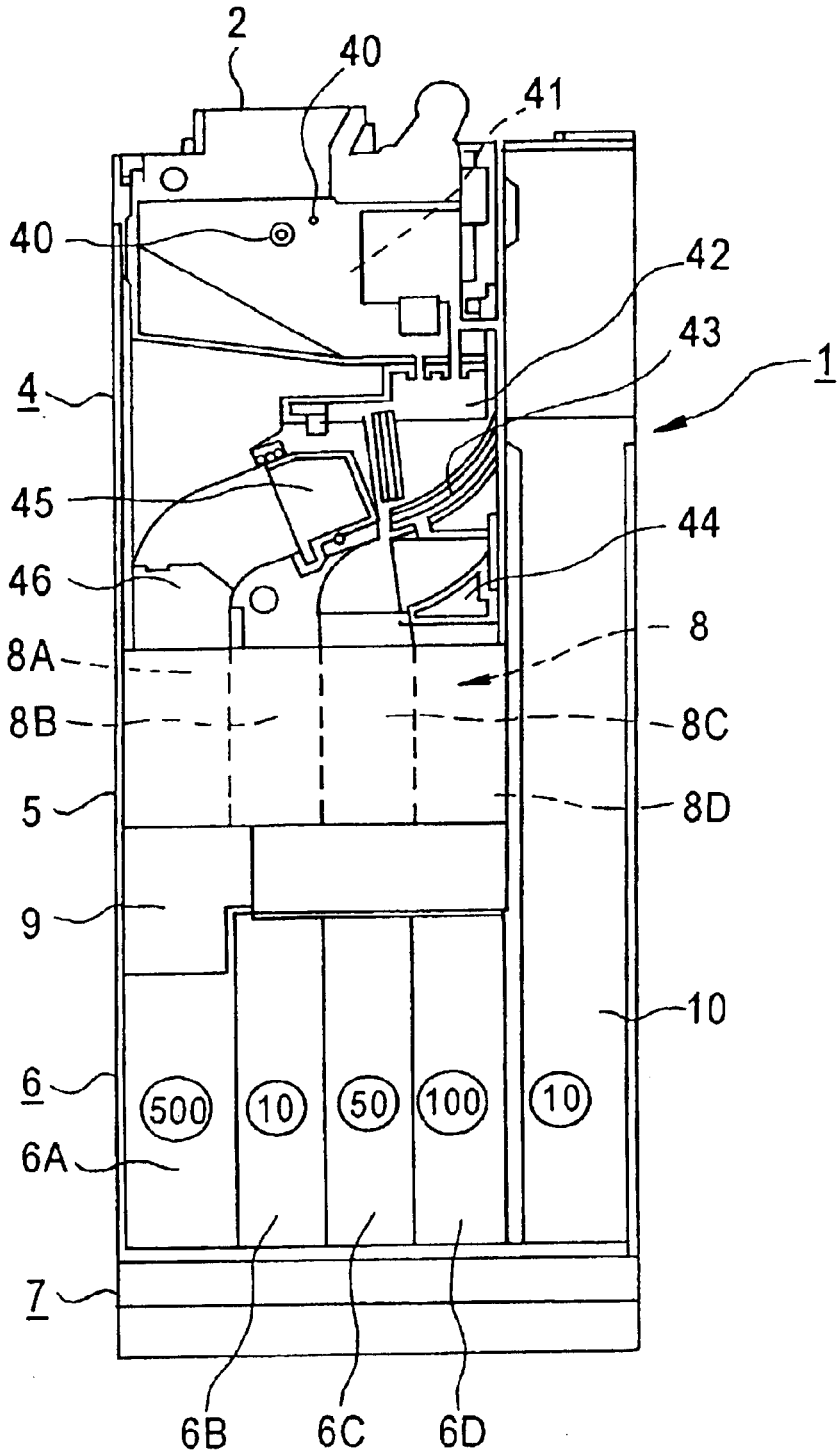
FIG. 1 is a front view of a coin dispensing apparatus embodying the invention.
Figure 2:
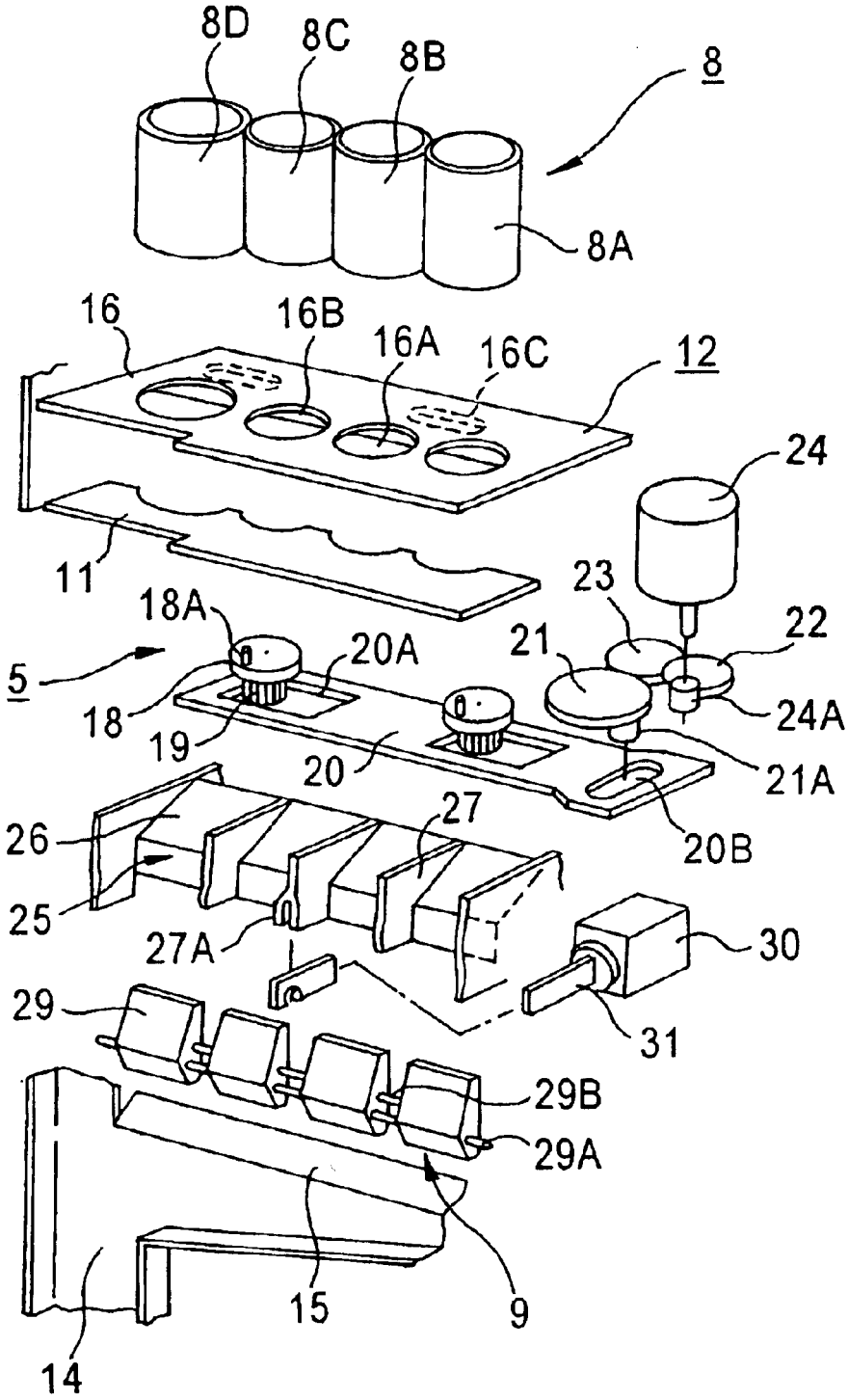
FIG. 2 is an exploded perspective view of the holding unit.

A first preferred embodiment of the invention will be explained in details below, referring to the drawings.

In FIG. 1, reference numeral 1 is the body of a coin dispensing apparatus to be included in an automatic vending machine etc. and in its upper part, a coin inserting aperture 2 into which coins are put is provided. The apparatus comprises a sorting unit 4 which has a coin discriminating device to discriminates genuineness and the kind of a coin to be put into it through the inserting aperture 2, namely, plural magnetic sensors 40 and sorts the coin 3 this discriminated, and a holding unit 5 which is provided under the sorting unit 4 and temporally holds the genuine money (coins 3) sorted by the sorting unit 4, a coin storing unit 6 which is provided under the holdings unit 5, comprises plural storing cylinders 6A, 6B, 6C and 6D and stores change for sale of an article, and a coin repayment unit 7, being provided in the lower part of the body of the coin dispensing apparatus, from which the coin 3 is returned when the coins 3 is discriminated as an imitation by the sorting unit 4 or when returning operation is made by a customer. Furthermore, a counterfeited coin returning passage (not shown) which connects the sorting unit 4 and the coin repayment unit 7 is provided at the back side of the coin dispensing apparatus.

Also, the magnetic sensors 40 of the sorting unit 4 are positioned facing a coin passage 41 of sorting unit where the coin put into the unit through the inserting aperture 2 passes. It detects the shape, thickness etc. of the coins. Further, the magnetic sensors 40 are connected with a control device (not shown) composed of microcomputer, in which genuineness and kind of coins are discriminated by comparing data operated from the result detected by the magnetic sensors 40 with a reference data stored therein. In accordance with this discrimination, the operation of various gates mentioned later is controlled.

The sorting unit 4 comprises a genuineness sorting gate 42 facing the lower end of the coin passage 41 of sorting unit, and succeeding gate group for sorting coins every coin kind. The gate group is composed of four gates, namely, a first gate 13, a second gate 44, a third gate 45 and a forth gate 46.

The genuineness sorting gate 42 is of a type that rotates, directing the valve upwards, in the front-and-back direction (orthogonal direction to the surface of the drawing sheet), and is operated by a solenoid not shown. When the coins are discriminated as genuine, it sorts the coins every coin kind to each coin-kind sorting gate 43, 44, 45 and 46, and when coins are discriminated as imitation, it guides them to the coin repayment unit 7.

Also, the holding unit 5 comprises a plurality of holding tubes 8A, 8B, 8C and 8D which are provided every coin kind (500 yen, 10 yen, 50 yen and 100 yen from the left) to receive the genuine coins sorted at the sorting unit 4, and a sorting device 9 which is provided at the lower part of the respective holding tubes 8A, 8S, 8C and 8D, and sweeps the coins at the lowest position in the holding cylinder 8, and sorts the coins swept to the coin storing unit 6 or the coin repayment unit 7.

Like this, since the apparatus comprises the holding unit 5 between the coin storing unit 6 and the sorting unit 4, and the coins have already been sorted every coin kind at the holding unit 5, it can return, in the lump, the coins held temporally in the holding unit 5.

Furthermore, 10 is a coin storing cylinder for 10 yen which stores most popularly used 10 yen as change.

The sorting device 9 of the holding unit 5 in this invention will be explained referring to the drawing.

The sorting device 9 comprises a receiving member 11 which supports the coin 3 at the lowest position in the holding cylinder 8, a wiper 12 which is provided between the receiving member 11 and the holding cylinder 8 and draw out the coin 3 at the lowest position, a coin storing passage 13 which introduces the coin 3 drawn out by the wiper 12 into the coin storing cylinder 6, a repayment passage 14 which introduces the coin 3 into the coin repayment unit 7, and a guide shoot 15 which divides between the repayment passage 14 and the coin storing passage 13.

Also, the wiper 12 is composed of a coin catching plate 16 having holes 16A which are formed corresponding to the respective holding cylinders 8A, 8B, 8C and 8D, have larger diameter than the inner diameter of the holding cylinder 8, and catch the coin 3. The coin catching plate 16 has a thickness thinner than that of one coin. Under the hole 16A of the coin catching plate 16, slope portion 16B which slants towards a direction for the coins to be swept.

Further, on the undersurface of the coin catching plate 16, a slide groove 16C which extends in the right and left direction is formed. In the slide groove 16C, a projection 18A of a rotary pulley 18, which protrudes upwards and is movable in the right-and-left direction, is located.

A pulley gear 19 is provided at the lower part of the rotary pulley 18, and under the coin catching plate 16, a plate 20 in which a straight bevel gear rack 20A engaging with the pulley gear 19 is located.

Also, at one end of the plate 20, a rectangular hole 20B which extends in the before and behind direction is formed. In the rectangular hole 20B, a guide bar 21A of a drive gear 21 is located to slide the plate 20 in the right and left direction.

Furthermore, the drive gear 21 iv driven via a first transmission gear 22, a second transmission gear 23 by an electric motor 24, 24A is a pinion gear fixed to the rotary shaft of the electric motor 24. Driving system is composed of these components.

Further, under the coin catching plate 16, a slope shoot 26, which forms a take-in passage 25 for introducing the coins 3 swept to the repayment passage 14 or the coin receipt passage 13, is provided. And, in the slope shoot 26, diaphragms 27, 27 . . . which divide the take-in passage is provided, and a notch 27A is formed in one of the diaphragms 27, 27 . . . .

Also, at the tip of the guide shoot 15, a damper 29 of the sorting device 9 is located.

The damper 29 has a shape that the upper part is sharpened and is able to rotate around a rotation shaft 29A. Further, a fitting shaft 29B is provided above the rotating shaft 29A with which an arm 31 of a solenoid 30 is connected. Furthermore, 30A is a force-giving spring which gives an arm 31 a force towards the direction to push out the arm.

Further, the solenoid 30 is located under the slope shoot 26, and the arm 31 connected with the solenoid 30 passes trough the notch 27A formed in the diaphragm 27.

Further, in the lower part of the slope shoot 26, a concave portion 26A, in which the chip of the damper 29 is located, is formed, and in the lower part of the receiving member 11, too, a concave portion 11A is formed to receive the tip of the damper 29.

Now, the operation of the coin dispensing apparatus of thin embodiment structured as mentioned in the above will be explained.

First, coins 3 put into the apparatus from the coin inserting aperture 2 are sorted in the sorting unit 4 as to genuineness and kind of coin, introduced to the holding cylinders 8A, 8B, 8C and 8D of the holding unit 5 which are provided every coin kind, and there genuine coins are placed on the coin receiving member 11.

Furthermore, counterfeited coins are returned through the counterfeited coin returning passage to the coin repayment unit 7.

Figure 3:
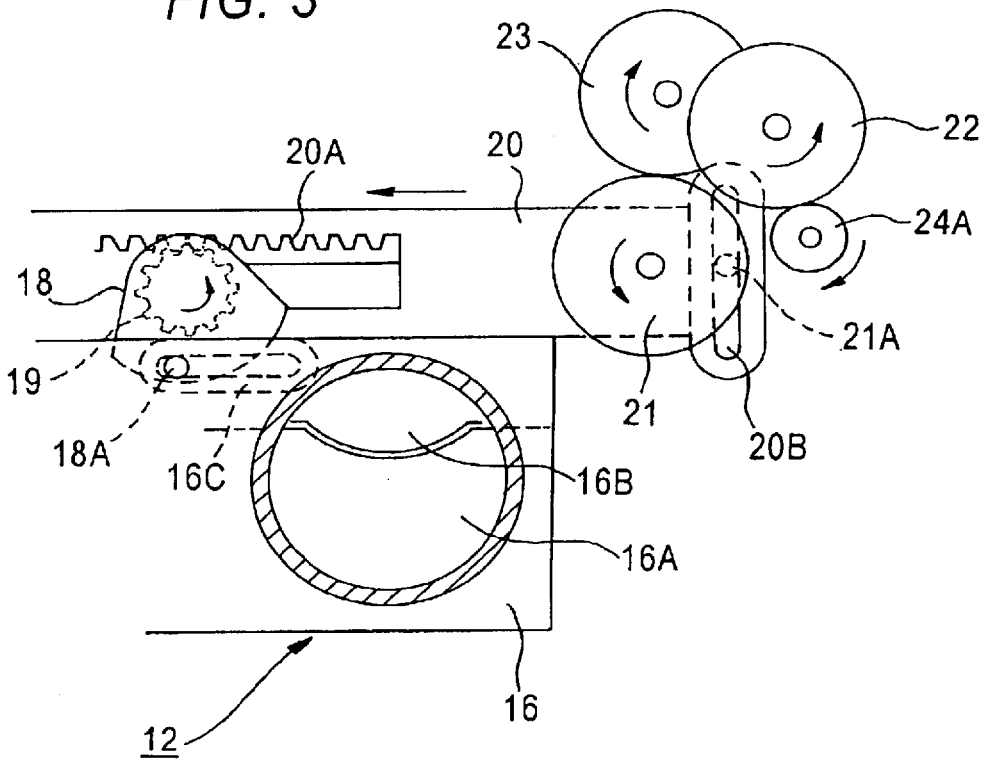
FIG. 3 shows the structure of the drive system to make the wiper drive.
Figure 4:
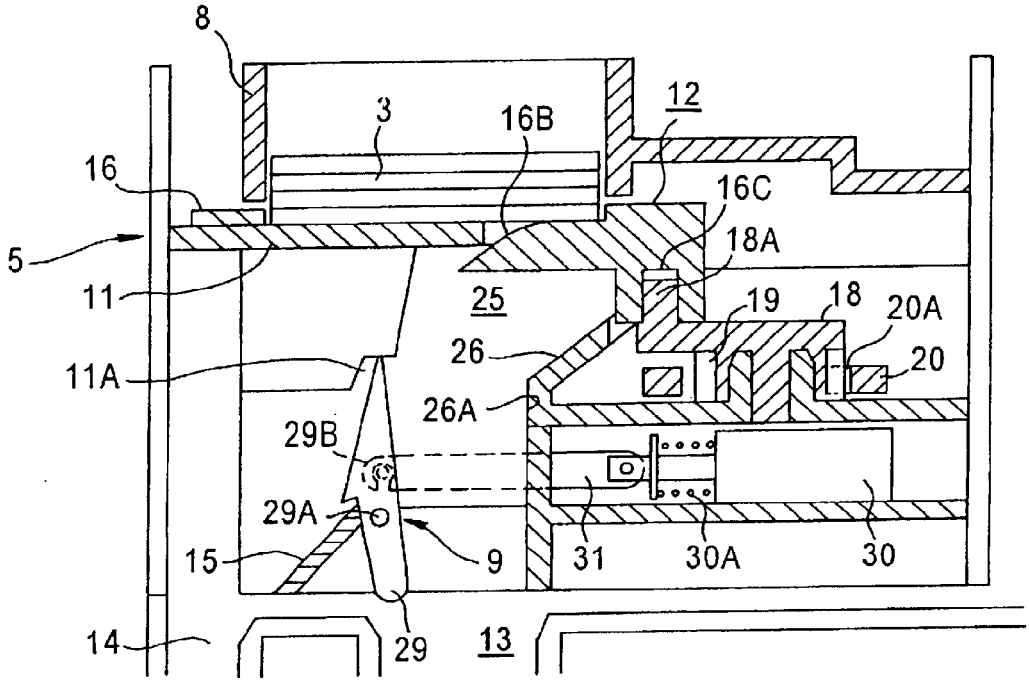
FIG. 4 is a sectional side view showing the holding unit.
Figure 5:
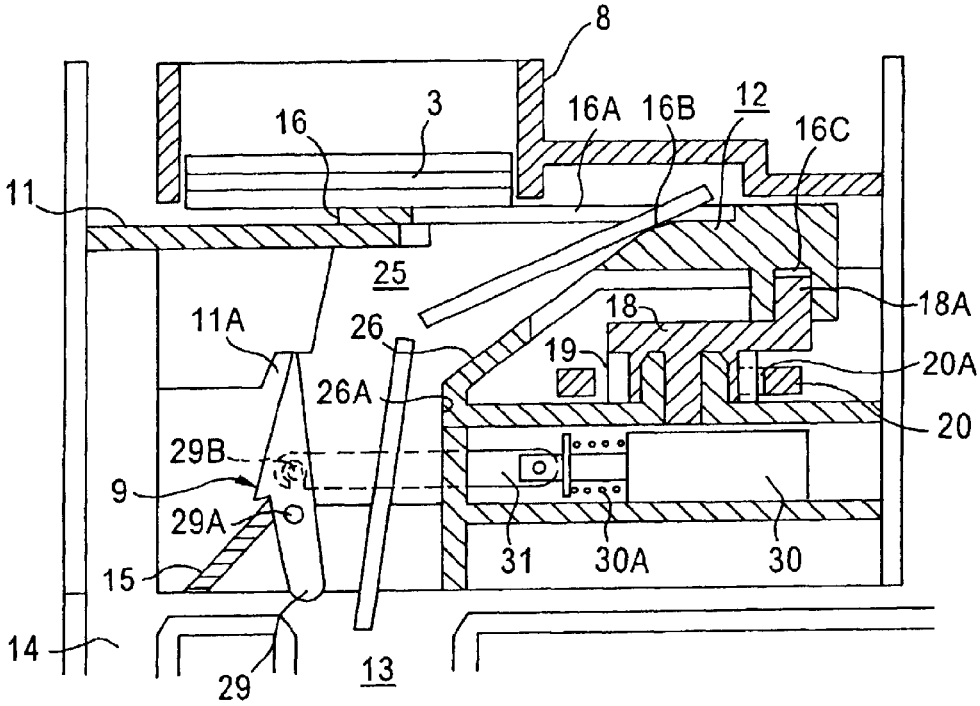
FIG. 5 is a sectional side view shoving the holding unit at the time of coin receiving.

When an article is sold in a state that the coins are being held within the holding cylinder 8, as shown in FIG. 3 to FIG. 5, the electric motor 24 starts driving and rotates the drive gear 21 via the first transmission gear 22 and the second transmission gear 23. At this time, since the guide bar 21A is located in the rectangular hole 20B of the plate 20, the plate 20 moves to the right and left direction and the straight bevel gear rack 20A makes the pulley gear 19 rotate, by which the rotary pulley 18 is rotated.

When the rotary pulley 18 rotates, the pulley-projection 18A of the rotary pulley 18 slides sideways along the sliding groove 16C of the coin catching plate 16, and makes the coin catching plate 16 slide forwards.

Because of this, the coins 3 held in the holding cylinder 8 leave the hole 16A and are swept away to the sweep-away direction, namely, to the back.

At this time, the solenoid 30 is off, and the damper 29 of the sorting device 9 is given a force backward by the force-giving spring 30A. Accordingly, the damper 29 blocks the repayment passage 14, and the coins 3 swept are introduced via the coin storing passage 13 into the coin storing unit 6.

Also, in case that an returning operation is made by a customer in a state that the coins 3 are placed on the receiving member 11, the solenoid 30 is switched on, and the arm 31 is drawn against the force by the force-giving spring 30A. With this movement, the damper 29 blocks the coin storing passage 13, so that the coins 3 are swept via the repayment passage 14 to the coin repayment unit 7.

Since the apparatus is structured as mentioned in the above, even if the coins 3 can not be discriminated as imitation by the sorting unit 4, the same coins 3 as those put into the apparatus are returned. Therefore, money exchange fraud, namely, that genuine coins within the body of the cash dispensing apparatus are stolen by first putting into and next return from the apparatus, can be prevented.

As mentioned in details above, according to the invention, the holding unit of simple structure can be made without using a lifting mechanism etc., so that rise in cost, machine trouble etc. can be prevented to the utmost.

Also, since such structure that the coin storing passage and the repayment passage, both being indispensable structure, are switched by the damper provided under the wiper, it becomes unnecessary to provide additionally a lifting apparatus etc., so that coins can be sorted to the coin storing unit or the coin repayment unit without making the coin dispensing apparatus larger.

Accordingly, an apparatus, which is simple in structure and low in cost and prevents money exchange fraud, can be provided.

Next, another embodiment according to this invention will be described. The explanation on the structure of the apparatus other than that of a sort-and-take-out device of the holding unit is omitted because the structure is same as those of the first embodiment described above.

Referring to the drawings, the sort-and-take-out device 9B of the holding unit 5 in this second embodiment is explained below.

The sort-and-take-out device 93 comprises a receipt-for-storing member 51 which supports a coin 3 at the lowest position in the holding cylinder 8, a wiper 52 which is provided between the receipt-for-storing member 51 and the holding tube 8, and takes out the coin 3 at the lowest position, a coin storing passage 53 which introduces the coin 3 taken out by the wiper 52 into the coin storing unit 6, a repayment passage 54 which introduces the coin 3 into the coin repayment unit 7, and a guide shoot 55 which divides between the repayment passage 54 and the coin storing passage 53.

Also, the wiper 52 comprises a coin catching plate 56, being formed thinner than the thickness of one coin, in which has holes 56A corresponding to the respective holding cylinders 8A, 8B, 8C and 8D, has larger diameter than the inner diameter of the holding cylinder 8, and in which the coin 3 is located, and a moving member 57 connected with the coin catching plate 56.

In this coin catching plate 56, a concave portion 56B and a slide groove 56C, which extends in the right and left direction, is formed. Further, on the upper surface of the moving member 57, a concave portion 57A is formed at a position corresponding to the concave portion 56B.

Also, in the slide groove 56C of the coin catching plate 56, a guide bar 58D, which protrudes on the undersurface of a rotary pulley 58A of a driving system 52 comprising an electric motor not shown etc, is located in a state being able to slide.

Because of this, when the rotary pulley 58A rotates, the wiper 52 slides in the before and behind direction.

Figure 6:
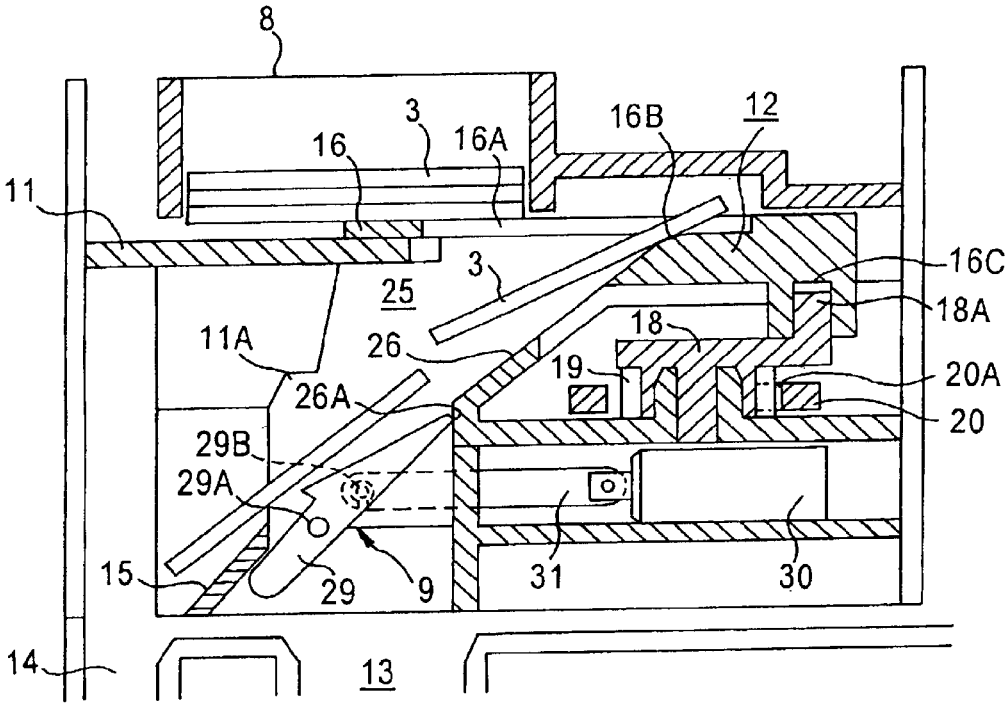
FIG. 6 is a sectional side view showing the holding unit at the time of coin returning.
Figure 7:
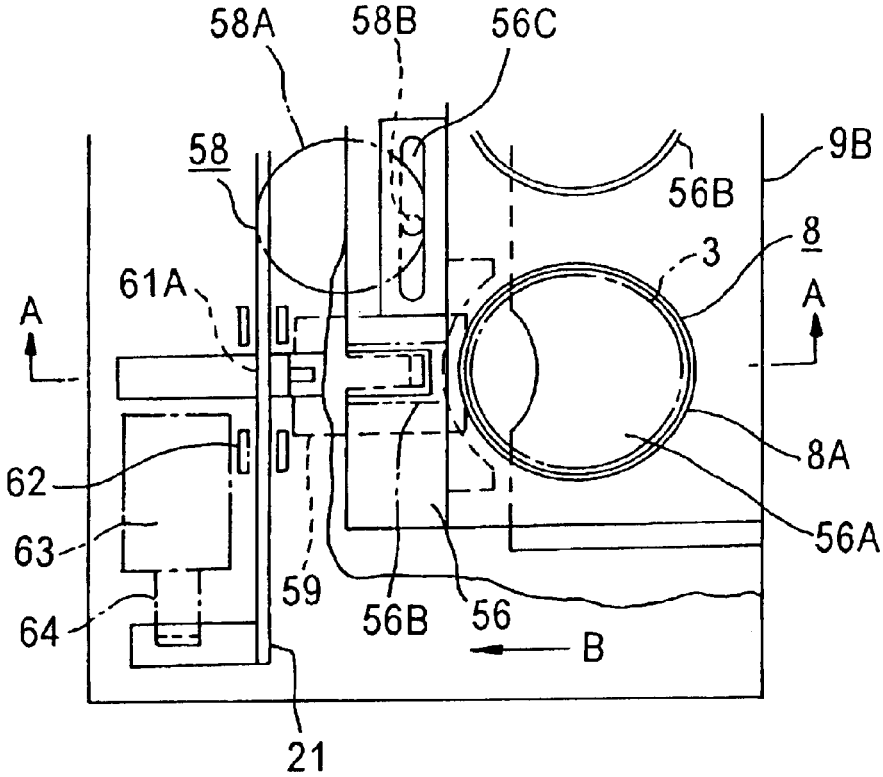
FIG. 7 is a planar view of the holding unit.
Figure 8:
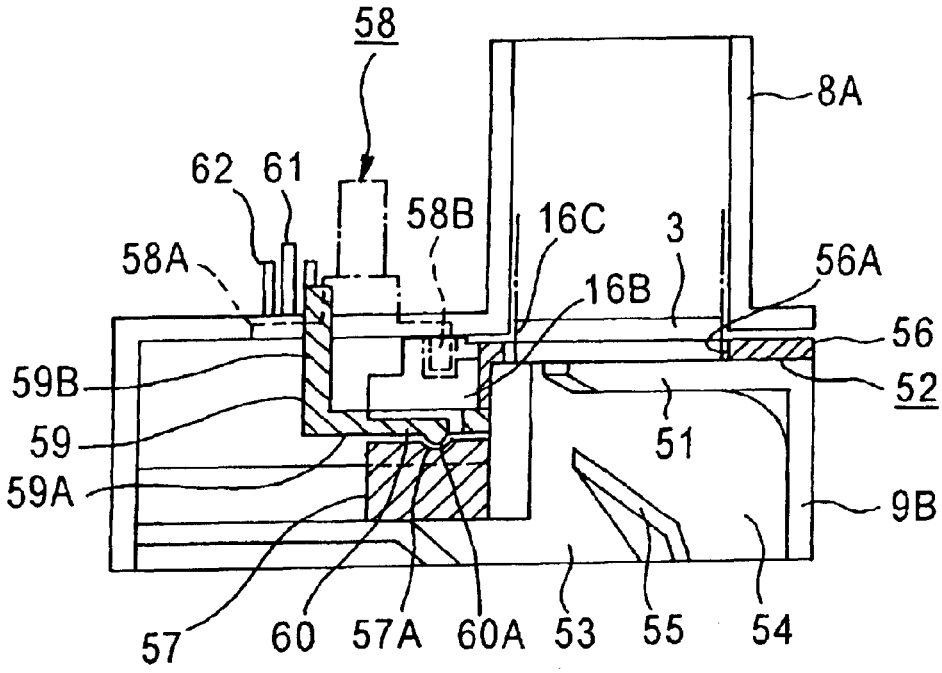
FIG. 8 is a view taken on line A—A of FIG. 7.

Further, as shown in FIG. 5 to FIG. 7, in the concave portion 56B of the coin catching plate 56, a receiving member (hereinafter called receiving plate) 59 on which the coin 3 taken out is located. The receiving plate 59 comprises a coin receiving part 59A which receives the coin, a stopping pole 59D provided vertically on a rear part of the coin receiving part 59A, and a fitting plate 60 which is provided at the canter portion of the coin receiving part 59A and protrudes downward.

Furthermore, the fitting plate 60 has elasticity against the coin receiving part 59A.

Also, a blocking plate 61, which is formed movable in the right and left direction by a solenoid 63, is provided on the upper surface of the front part of the sort-and-take-out device 9B, namely, in front of the holding cylinder 8. The blocking plate 61 is supported by a supporting plate 62 protruded on the sort-and-take-out device 9B. Furthermore, 64 is a force-giving spring which gives a force to one direction when the solenoid 63 is off.

And, a passage 61A, in which the stopping pole 59B of the receiving plate 59 can pass, is formed at a part of the blocking plate 21, and when the solenoid 63 is off, the force-giving spring 64 makes the blocking plate 61 slide to move, by which the stopping pole 59B becomes possible to pass the passage 61A. Also, when the solenoid 63 is on, the blocking plate 61 slides to move against the force of the force-giving spring 64, thereby relative position between the stopping pole 59B and the passage 61A being changed, so that the stopping pole 59B hits the blocking plate 61 and becomes unable to slide further.

In operation of the coin dispensing apparatus in the second embodiment, first, as is the case with the first embodiment, coins 3 put into the apparatus through the coin inserting aperture 2 are sorted at the sorting unit 4 as to genuineness and kind of coin, and introduced to the holding cylinders 8A, 8B, 8C and 8D of the holding unit 5 every coin kind, and are placed on the receipt-for-storing member 11.

When an article is sold under the state, the solenoid 63 is turned off, and positions of the passage 61A of the blocking plate 61 and the stopping pole 59B coincides with each other by the force of the force-giving spring 64. In this state, when the rotating pulley 58A of the drive system 58 rotates, the guide bar 58B slides in the right and left direction, by which the wiper 52 moves forward, namely, to the direction show with arrow B in FIG. 7.

Figure 13:
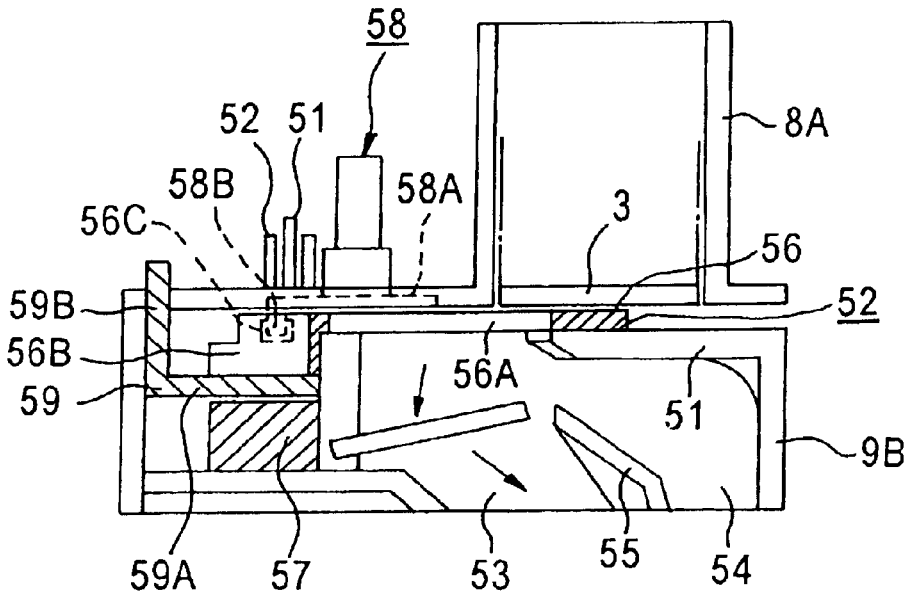
FIG. 13 is a sectional side view of the holding unit when coins are stored in the coin storing unit.
Figure 14:
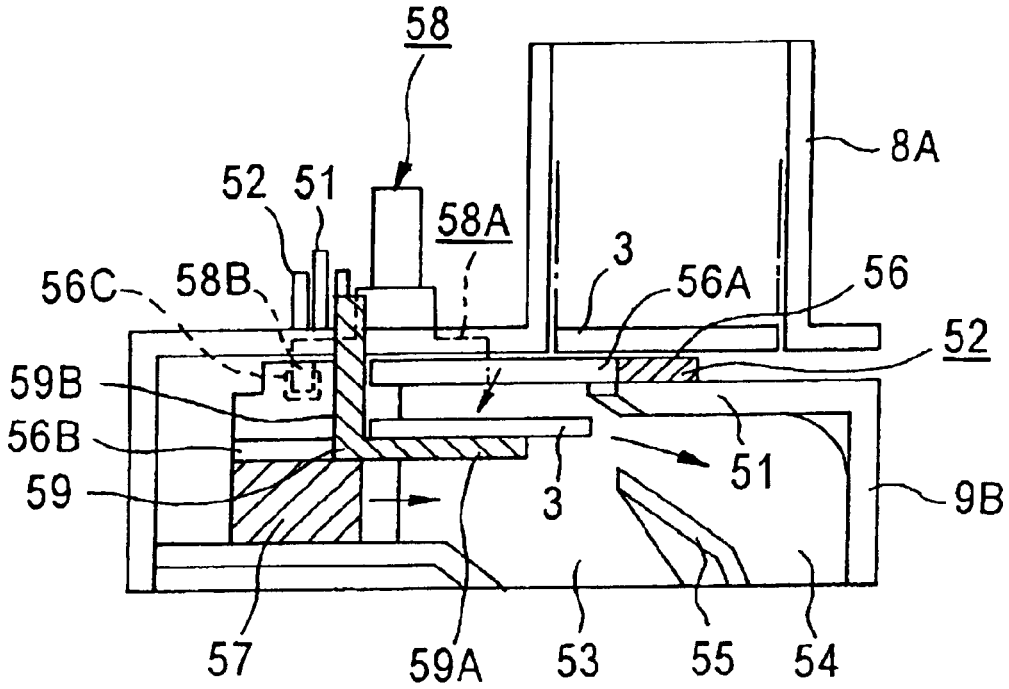
FIG. 14 is a sectional side view of the holding unit when coins are swept to the coin repayment unit.

At this time, the projection 60A of the fitting plate 60 of the receiving plate 59 is engaged with the concave portion 57A on the upper surface of the moving member 57, and the passage 61A of the blocking plate 61 allows insertion therein of the stopping pole 59B of the receiving plate 59, so that the receiving plate 59 also moves, along with the movement of the wiper 52, to arrow B direction in FIG. 7, namely, towards the front. Accordingly, the coins at the lowest position within the holding tube 8, as shown by an arrow in FIG. 13, is introduced into the coin storing passage 53 and stored in the predetermined coin storing unit 6.

Also, in case that an returning operation is made by a customer, solenoid 63 is switched on, and relative position between the passage 61A of the blocking plate 61 and the stopping pole 59B of the coin receiving member changes. Under the state, when the rotary pulley 18A of the drive system se rotates, the guide bar 58B slides to the right and left direction and the wiper 52 moves forwards.

With the movement of the wiper 52, the receiving plate 59 also moves forwards, but the blocking plate 61 and the stopping pole 59B of the receiving plate 59 hit with each other and the receiving plate 59 can not move further, so that the coin receiving part 59A of the receiving plate 59 becomes located under the hole 56A of the coin catching plate 56 which has completed the movement. Accordingly, the coins swept becomes a state being placed on the coin receiving part 59A.

In this state, the pulley 58A is rotated at 180 degrees. When the rotary pulley 58A of the drive system 58 further rotates, the wiper 58A returns again to the inner side. At this time, the coin 3 is pushed out towards the direction of the repayment passage 54 because the coin 3 swept has been placed on the coin receiving part 59A of the receiving plate 59.

Figure 9:
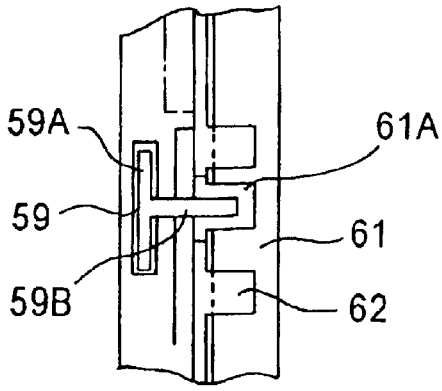
FIG. 9 is a sectional rear view showing the vicinity of the receiving member of the holding unit.
Figure 10:
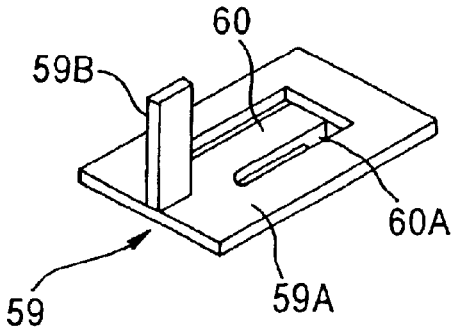
FIG. 10 is a perspective view of the receiving member.
Figure 11:
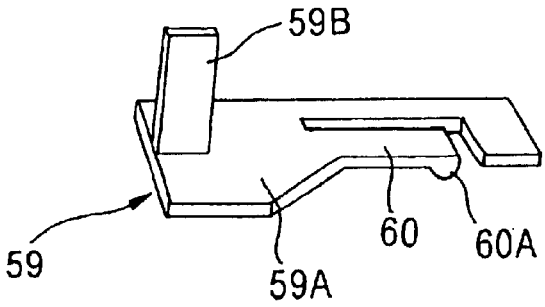
FIG. 11 is a partly exploded perspective view of the receiving member.
Figure 12:
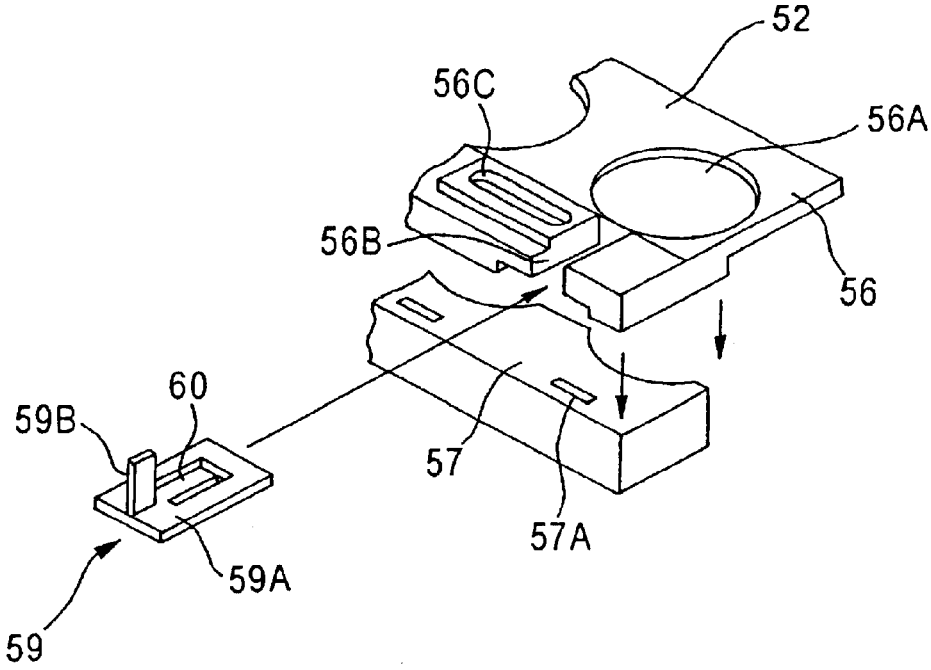
FIG. 12 is a perspective view of the receiving member when being fabricated.

Accordingly, at first, the coin 3 at the lowest position within the holding cylinder a is placed on the coin receiving part 59A of the receiving plate 59, and as shown with an arrow in FIG. 9, is introduced into the repayment passage 54, and swept to the repayment unit 7.

Since the apparatus is structured as mentioned above, even if counterfeited coins 3 put into the apparatus can not be discriminated as imitation in the sorting unit 4, the same coins 3 are returned. Therefore, money exchange fraud, namely, that genuine coins 3 within the body of a cash dispensing machine are taken out by first putting the coins 3 into the apparatus and then making returning operation, can be prevented.

As mentioned in details above, according to the invention, since the receiving plate, which operates in linkage with the wiper or individually, is provided near the wiper, coins can be sorted to the coin storing unit or the coin repayment unit without necessity to make the coin dispensing apparatus larger.

Accordingly, an apparatus, which is simple in structure and low in cost and can prevent money exchange fraud, can be provided.

As this invention may be embodied in several forms without departing from the spirit of essential characteristics thereof, the present embodiment is therefore illustrative and not restrictive, since the scope of the invention is defined be the appended claims rather than by the description preceding them, and all changes that fall within meets and bounds of the claims, or equivalence of such meets and bounds are therefore intended to be embraced by the claims.

What is claimed is:

1. A coin dispensing apparatus for an automatic vending machine, comprising:

an inserting aperture, provided at an upper part of a main body, for receiving coins to be inserted thereinto;

a first sorting unit comprising a coin discriminating device for discriminating genuineness of coins inserted into said inserting aperture, said sorting unit sorting said coins discriminated in said coin discriminating device;

a holding unit for temporally holding said coins sorted in said first sorting unit after the coins are inserted until goods are dispensed from the automatic vending machine or a user requests return of the coins;

a coin repayment unit, provided at a lower part of said main body, for giving change to a customer when goods are sold;

a coin storing unit provided under said holding unit for supplying coins to the coin repayment unit; and wherein said coin dispensing apparatus has at least one holding cylinder provided in said holding unit for temporally holding said coins sorted in said first sorting unit, said at least one holding cylinder holding said coins for each coin kind, a wiper provided at a lower part of said at least one holding cylinder for sweeping said coins temporally held in said at least one holding cylinder, a diverting unit provided under said wiper for diverting said coins swept by said wiper to said coin storing unit or said coin repayment unit, and when a coin-returning operation is performed after coins are inserted into said coin dispensing apparatus, the inserted coins being temporally held in said holding cylinder are returned along a path separate from said coin storing unit.

2. A coin dispensing apparatus for an automatic vending machine as defined in claim 1, wherein:

said coin dispensing apparatus has a coin storing passage connected with said coin storing unit and a repayment passage connected with said coin repayment unit, and a damper provided in said diverter for switching said coin storing passage and said repayment passage.

3. A coin dispensing apparatus for an automatic vending machine, comprising:

an inserting aperture, provided at an upper part of a main body, for receiving coins to be inserted thereinto;

a sorting unit comprising a coin discriminating device for discriminating genuineness of coins inserted into said inserting aperture, said sorting unit sorting said coins discriminated in said coin discriminating device;

a holding unit for temporally holding said coins sorted in said sorting unit after the coins are inserted until goods are dispensed from the automatic vending machine or a user requests return of the coins;

a coin repayment unit, provided at a lower part of said main body, for giving change to a customer when goods are sold;

a coin storing unit provided under said holding unit for supplying coins to the coin repayment unit; and wherein said coin dispensing apparatus has at least one holding cylinder provided in said holding unit for temporally holding said coins sorted in said sorting unit, said at least one holding cylinder holding said coins for each coin kind, a wiper provided at a lower part of said at least one holding cylinder for sweeping said coins temporally held in said at least one holding cylinder, a receiving member provided near said wiper for sorting said coins swept by said wiper to said coin storing unit or said coin repayment unit by operation with or without being linked to said wiper, and when a coin-returning operation is performed after coins are inserted into said coin dispensing apparatus, the inserted coins being temporally held in said holding cylinder are returned along a path separate from said coin storing unit.

4. A coin dispensing apparatus for an automatic vending machine, as defined in claim 3, wherein operation of said receipt member is linked with said wiper in storing coins in said coin storing unit, and is not linked with said wiper in sweeping coins to said coin repayment unit.

5. A coin dispensing apparatus for an automatic vending machine, as defined in claim 1, wherein during a selling operation, the coins in said holding unit are transferred to said coin storing unit, and during a returning operation, a passage from said holding unit to said coin storing unit is blocked and the coins in said holding unit are transferred to said coin repayment unit via a repayment passage between said holding unit and said coin repayment unit.

6. A coin dispensing apparatus for an automatic vending machine, as defined in claim 3, wherein during a selling operation, the coins in said holding unit are transferred to said coin storing unit, and during a returning operation, a passage from said holding unit to said coin storing unit is blocked and the coins in said holding unit are transferred to said coin repayment unit via a repayment passage between said holding unit and said coin repayment unit.

* * * * *